United States Patent [19]

Yagishita et al.

[11] 4,454,213

[45] Jun. 12, 1984

[54] ORGANIC PHOTOSENSITIVE MATERIAL FOR ELECTROPHOTOGRAPHY

[75] Inventors: Teruo Yagishita, Yokohama; Seiji Okada, Sagamihara; Toshiaki Narusawa; Hirofumi Okuyama, both of Sagamihara, all of Japan

[73] Assignee: Fujitsu Limited, Kawasaki, Japan

[21] Appl. No.: 366,376

[22] Filed: Apr. 7, 1982

[30] Foreign Application Priority Data

Apr. 9, 1981 [JP] Japan ..... 56-53302
Sep. 11, 1981 [JP] Japan ..... 56-142384

[51] Int. Cl.[3] ..... G03G 5/06
[52] U.S. Cl. ..... 430/76; 430/79; 430/96
[58] Field of Search ..... 430/79, 80, 81, 82, 430/76, 96

[56] References Cited

U.S. PATENT DOCUMENTS 3,926,629 12/1975 Weigl ..... 430/37
4,214,907 7/1980 Nakazawa et al. ..... 430/82
4,218,528 8/1980 Shimada et al. ..... 430/76

*Primary Examiner*—John D. Welsh
*Attorney, Agent, or Firm*—Staas & Halsey

[57] ABSTRACT

A photosensitive material for electrophotography is provided which has a very high sensitivity to rays having a wavelength included in the oscillation wavelength region of a laser printer, especially a semiconductor laser printer, and which also has a high charge potential. This photosensitive material comprises a phthalocyanine pigment, poly-N-vinylcarbazole, and an organic resin in which said phthalocyanine pigment and poly-N-vinylcarbazole are dispersed, wherein the weight ratio of phthalocyanine pigment to poly-N-vinylcarbazole is in the range of from 1.2 to 12 and the content of the organic resin is 35% to 70% by weight based on the total amount of the photosensitive material.

10 Claims, 4 Drawing Figures

ORGANIC PHOTOSENSITIVE MATERIAL FOR ELECTROPHOTOGRAPHY

BACKGROUND OF THE INVENTION

The present invention relates to a photosensitive material for electrophotography. More particularly, it relates to a photosensitive material for electrophotography which has a high photosensitivity to rays having a wavelength included in the oscillation wavelength region of a laser printer, especially a semiconductor laser printer, and also which has a high charge potential.

Many photosensitive materials, such as Se, Se-Te, CdS, ZnO, and organic photoconductors, are known as photosensitive materials having a sensitivity to rays having a wavelength included in the visible ray wavelength region, that is, the wavelength region of from 370 to 720 nm. Some of these photosensitive materials have already been used in practice for electrophotographic copying machines or laser printers comprising an He-Ne laser as the beam source. However, almost no photosensitive materials have been known having a sensitivity to rays having a wavelength included in the semiconductor laser oscillation wavelength region, that is, the near infrared ray wavelength region. Only CdS, As-Te-Se, and phthalocyanine photosensitive materials are known.

CdS and As-Te-Se photosensitive materials are harmful and poisonous. Use of these photosensitive materials is undesirable because of environmental pollution and also because of the necessity for special consideration to safety in the manufacturing process. As-Te-Se photosensitive material is further disadvantageous as its manufacturing process requires a vacuum evaporation deposition apparatus and is complicated. And, while CdS has good photosensitivity, it is disadvantageous in that it requires a special charging process since the charge acceptance is low.

Phthalocyanine pigment, on the other hand, has long been known to have photoconductivity, is cheap, and is very low in toxicity. Research has consequently been performed on applications of phthalocyanine pigment in the field of electrophotography to copying machines, laser printers, and the like as the photosensitive material. Phthalocyanine pigment cannot be used for the production of a photosensitive material alone because it has no film-forming property and because vacuum evaporation deposition thereof is very difficult. Accordingly, a photoconductive film is ordinarily formed by dissolving or dispersing the phthalocyanine pigment together with a binder in an organic solvent. The thus formed photoconductive coating solution or dispersion is then coated at a dried thickness of several microns to scores of microns on an electroconductive substrate by means of a doctor blade, a bar coater, a roll coater, or the like.

The photosensitive film of the phthalocyanine pigment prepared according to the above-mentioned process shows a so-called induction phenomenon in which the decay just after irradiation is very small, that is, the irradiation energy is not utilized at a high efficiency. Accordingly, this photosensitive film is not sufficiently sensitive for the photosensitive material for a copying machine for electrophotography or a laser printer. The sensitivity to rays having a wavelength included in the semiconductor laser oscillation wavelength region is especially low.

As a means for overcoming the foregoing difficulties involved in the phthalocyanine photosensitive material, the present inventors have already proposed the addition of an oxadiazole derivative and of tetrathiafulvalene as third components to the phthalocyanine photosensitive material (Japanese Patent Application Nos. 55-120767 and 55-120779, respectively). However, the photosensitivity and charging property of these proposed photosensitive materials are still insufficient for photosensitive material for semiconductor laser printers.

Under these circumstances, the present inventors made various examinations on the above-mentioned phthalocyanine photosensitive material. As a result, the present inventors found that a photosensitive material for electrophotography which comprises a phthalocyanine pigment, poly-N-vinylcarbazole (PVCz), and an organic resin in which said phthalocyanine pigment and poly-N-vinylcarbazole are dispersed, wherein the weight ratio of phthalocyanine to PVCz is in the range of from 1.2 to 12 and the content of the organic resin is 35% to 70% by weight based on the total amount of the photosensitive material, possesses excellent photosensitivity and a high charge potential. On the basis of these findings, the present inventors accomplished this invention.

Prior patent applications with the same object as the present invention and disclosing a composition of the photosensitive material partially similar to the photosensitive material of the present invention include Japanese Laid-Open Patent Application No. 53-9537 (Toyo Ink K.K.) and Japanese Patent Application Publication No. 56-17657: (Xerox corporation). Japanese Laid-Open Patent Application No. 53-9537 relates to a method for sensitizing a poly-N-vinylcarbazole type photosensitive material for electrophotography, characterized in that 0.01 to 10 parts by weight of a phthalocyanine photoconductor, e.g. copper phthalocyanine, per 100 parts by weight of a polyvinylcarbazole type photoconductor, e.g., poly-N-vinylcarbazole, are dispersed in a binder resin. In this case, the weight ratio of copper phthalocyanine to PVCz is in the range of from 0.0001 to 0.1, which range is quite different from that in the present invention. This difference is considered to be ascribable to the following reasons. In Japanese Laid-Open Patent Application No. 53-9537, copper phthalocyanine, which is used as a sensitizer, is used for widening the spectral response of PVCz. The above-mentioned range is adopted for the purpose of maintaining the retention of charge, transparency, and self-film-forming property of the photosensitive material at satisfactory levels. On the other hand, in the present invention, copper phthalocyanine is mainly used for enhancing the photoconductivity of the photosensitive material. PVCz plays only an auxiliary role in the enhancement of the photosensitivity. As a result, the above-mentioned range is adopted. Also, PVCz and the organic resin contribute to the retention of charge of the photosensitive material.

Japanese Laid-Open Patent Application No. 53-9537 further discloses a styrene-acryl copolymer as the binder resin. The amount of this copolymer that is used is about 8.7% by weight based on the total amount of the photosensitive material, which amount is also different from the amount of the organic resin used in the present invention.

Japanese Patent Application Publication No. 56-17657 discloses an electron radiation-sensitive material comprising a phthalocyanine photoconductor and a PVCz photoconductor. In this case, an X-type metal-free phthalocyanine is used as the phthalocyanine photoconductor. The weight ratio of phthalocyanine to PVCz is in the range of from 0.00125 to 0.0625, which range is different from that in the present invention. The above-mentioned range disclosed in this patent is selected for obtaining an optimal mechanical property of the photosensitive material. Also, this patent only exemplifies various organic resins as the binder, and neither discloses nor suggests the amount of these resins used.

SUMMARY OF THE INVENTION

It is a primary object of the present invention to provide a photosensitive material which has a very high sensitivity to rays having a wavelength included in the semiconductor laser oscillation wavelength region and which also has a high charge potential.

Other objects and advantages of the present invention will become apparent from the following detailed description.

In accordance with the present invention, there is provided a photosensitive material for electrophotography, which comprises a phthalocyanine pigment, PCVz, and an organic resin in which said phthalocyanine pigment and PVCz are dispersed, wherein the weight ratio of phthalocyanine pigment to PVCz is in the range of from 1.2 to 12 and the content of the organic resin is 35% to 70% by weight based on the total amount of the photosensitive material.

BRIEF DESCRIPTION OF THE DRAWINGS

In FIG. 3, curve B represents the photo-decay characteristic of a photosensitive material comprising copper phthalocyanine and a polyester, and curve C represents the photo-decay characteristic of a photosensitive material comprising an X-type metal-free phthalocyanine and PVCz.

DETAILED DESCRIPTION OF THE PREFERRED EMBODIMENTS

The phthalocyanine pigment usable for the present invention may be selected from metalo-phthalocyanines pigments, and metal-free phthalocyanine pigments. Copper phthalocyanine is particularly preferable.

The organic resin usable for the present invention may be selected among polymer resins having a good film-forming property and a good adhesion to a substrate. For example, various polymer resins such as polyesters, acrylic resins and urethane resins may be used. From the viewpoint of the operational adaptability, polyester resins are particularly preferable. These organic resins serve as a binder in the photosensitive material. Preferable polyester resins usable for the present invention are those having a weight average molecular weight of from 5,000 to 400,000, and preferably, from 20,000 to 80,000.

Figure 1:
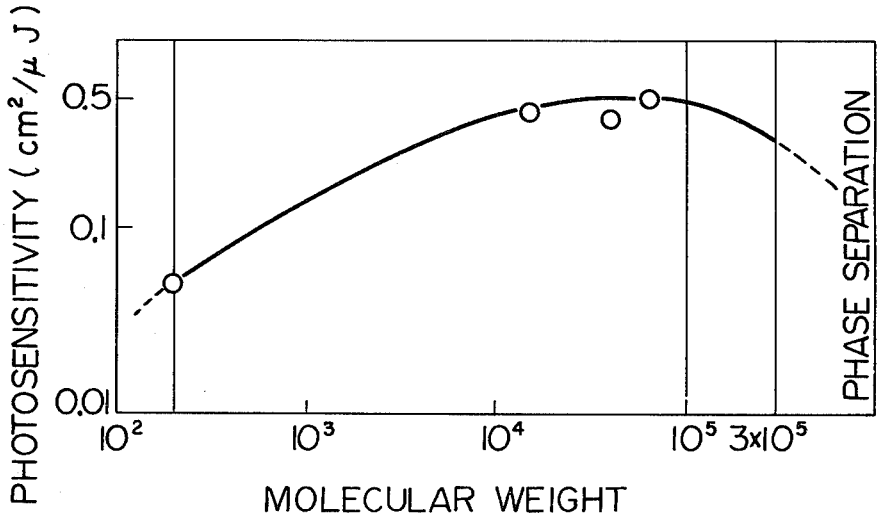
FIG. 1 is a graph showing the influences to the molecular weight of the PVCz in the photosensitive material on the photosensitivity.

Referring to FIG. 1, there is shown a graph illustrating the influences of the molecular weight of PVCz in the photosensitive material on the photosensitivity. In FIG. 1, the abscissa represents the molecular weight of PVCz, and the ordinate represents the photosensitivity of the photosensitive material.

In the present invention, it is indispensable that the amount of the organic resin should occupy 35% to 70% by weight of the total amount of the photosensitive material. The resons for this restriction are as follows. If the resin content is less than 35% by weight, the resultant photosensitive film exhibits a poor adhesion to the substrate and a deteriorated mechanical strength. Furthermore, the photosensitive material exhibits a low charge potential due to its poor dark resistance and a low surface charge-retaining ability in the dark. Therefore, such a photosensitive material is practically useless. If the resin content is more than 70% by weight, the resultant photosensitive material exhibits an enhanced adhesion and mechanical strength due to the presence of a large amount of the resin. Also, the charge potential and the surface charge-retaining ability in the dark of the photosensitive material are enhanced due to the increased dark resistance derived from the high content of the resin. However, the resultant photosensitive material is an insulator rather than a semiconductor. Therefore, even if the photosensitive material is irradiated with rays, no photocurrent is generated. Accordingly, such a photosensitive material is practically useless.

The PVCz, effective mainly for enhancing the charge potential of the photosensitive material, is illustrated hereunder.

Figure 2:
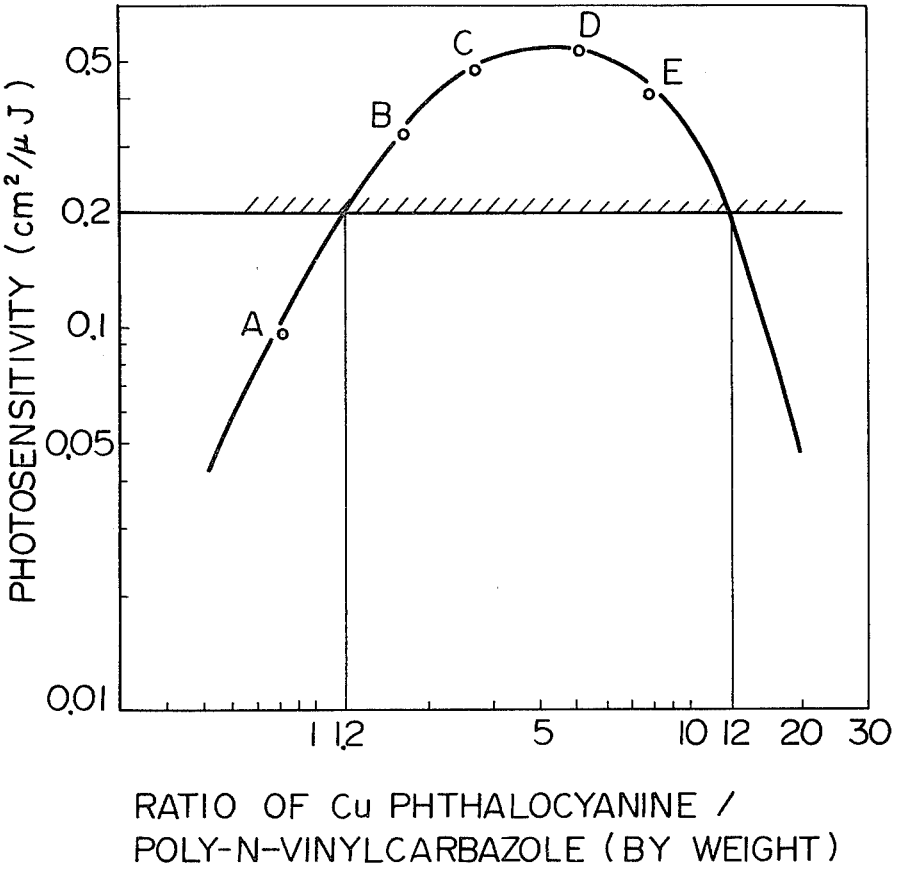
FIG. 2 is a graph showing the influences of the weight ratio of copper phthalocyanine to PVCz in the photosensitive material on the photosensitivity.

The amount of PVCz used should be such that the weight ratio of phthalocyanine to PVCz in the photosensitive material is in the range of from 1.2 to 12, as illustrated in the examples given hereinafter. The reasons for this restriction are as follows. That is, when the weight ratio of phthalocyanine to PVCz is less than 1.2, the distance between the phthalocyanine molecules in the photosensitive material is increased due to the presence of a large amount of PVCz, with the result that an adequate transfer of carriers is not achieved. Also, when the weight ratio exceeds 12, the number of the PVCz molecules capable of acting on the phthalocyanine is reduced, with the result that the resultant photosensitive material behaves in the same manner as a photosensitive material containing no PVCz. Therefore, it is found that when the weight ratio of phthalocyanine to PVCz is in the range of from 1.2 to 12, a high photosensitivity is obtained. The results obtained in the examples are shown in FIG. 2, in which the relation between the weight ratio of copper phthalocyanine to PVCz (abscissa) and the photosensitivity (ordinate) is illustrated. It is apparent from the graph shown in FIG. 2 that when the weight ratio of copper phthalocyanine to PVCz is in the range of from 1.2 to 12, a desirable photosensitivity is obtained.

The photosensitive material of the present invention comprising the phthalocyanine pigment, PVCz, and the organic resin can be applied to an electroconductive substrate according to a conventional method. More specifically, an organic solvent such as tetrahydrofuran, toluene, or xylene is added to the photosensitive material of the present invention. The resulting mixture is sufficiently blended by means of a ball mill or the like to form a coating dispersion for forming a photosensitive film. Then, the dispersion is coated on an electroconductive substrate at a dried thickness of from 5 to 30μ by means of a doctor blade, a bar coater, a roll coater, or the like, and the coated substrate is then dried.

The present invention will now be described in detail with reference to the following example, which by no means limit the scope of the invention.

EXAMPLE 1

Preparation of Poly-N-Vinylcarbazole

A three-necked flask having an inner volume of 500 ml was charged with 10 g of N-vinylcarbazole, 0.25 g of azobisisobutyronitrile, and 300 ml of toluene. The mixture was maintained at a temperature of 85° C. for 6 hours while the atmosphere within the flask was replaced with nitrogen gas. At the end of that time, the reaction mixture was gradually dropped into methanol, and the resultant mixture was dried in air, thereby to prepare white poly-N-vinylcarbazole (PVCz-A). The molecular weight characteristic of the PVCz-A was determined by means of liquid chromatography. The $M_w$, $M_n$ and $M_w/M_n$ obtained from the above analysis results are shown in Table 1.

TABLE 1

| Molecular Weight Characteristic of Poly-N—Vinylcarbazole | | |
|---|---|---|
| $\overline{M}_n$ | $\overline{M}_w$ | $\overline{M}_w/\overline{M}_n$ |
| $0.231 \times 10^5$ | $0.425 \times 10^5$ | 1.842 |

Preparation of a Coating Dispersion

A coating dispersion (A) was prepared by using the above-prepared PVCz-A. For comparison purpose, a coating dispersion (B) containing no PVCz-A and a coating dispersion (C) containing PVCz-B (Luvican M-170 commercially available from BASF Co.) but not a polyester resin were prepared. The composition of these coating dispersions are shown in Table 2.

TABLE 2

| Coating dispersion | A | B | C |
|---|---|---|---|
| β-type copper phthalocyanine[1] (g) | 10 | 10 | — |
| X-type metal-free phthalocyanine (g) | — | — | 0.3 |
| PVCz-A (g) | 2 | — | — |
| PVCz-B[2] (g) | — | — | 9.7 |
| Polyester resin[3] (g) | 18 | 20 | — |
| Tetrahydrofuran (ml) | 450 | 450 | 450 |
| Half-value exposure quantity[4] ($\mu J/cm^2$) | 4.2 | 12 | 7.4 |

Note
[1]"Lionol Blue SM" supplied by Toyo Ink Co.
[2]Luvican M170 supplied by BASF Company
[3]"Polyester Adhesive #49000

$$\left(\overline{M}_w = 0.698 \times 10^5, \overline{M}_n = 0.308 \times 10^5, \frac{\overline{M}_w}{\overline{M}_n} = 2.23\right)$$ "

supplied by Du Pont
[4]The photosensitivity is expressed by the reciprocal number [1/($E_{\frac{1}{2}}$)] of the half-value exposure quantity ($E_{\frac{1}{2}}$)

Each coating dispersion was prepared by charging the composition shown in Table 2 in a polyethylene wide-mouthed bottle having an inner volume of 1 liter and by milling it for 80 hours by using 600 g of alumina balls. Then, the resulting coating dispersion was coated on an aluminum plate at a dried thickness of 8.0 μm according to the doctor blade coating method. The coated aluminum plate was then dried.

Figure 3:
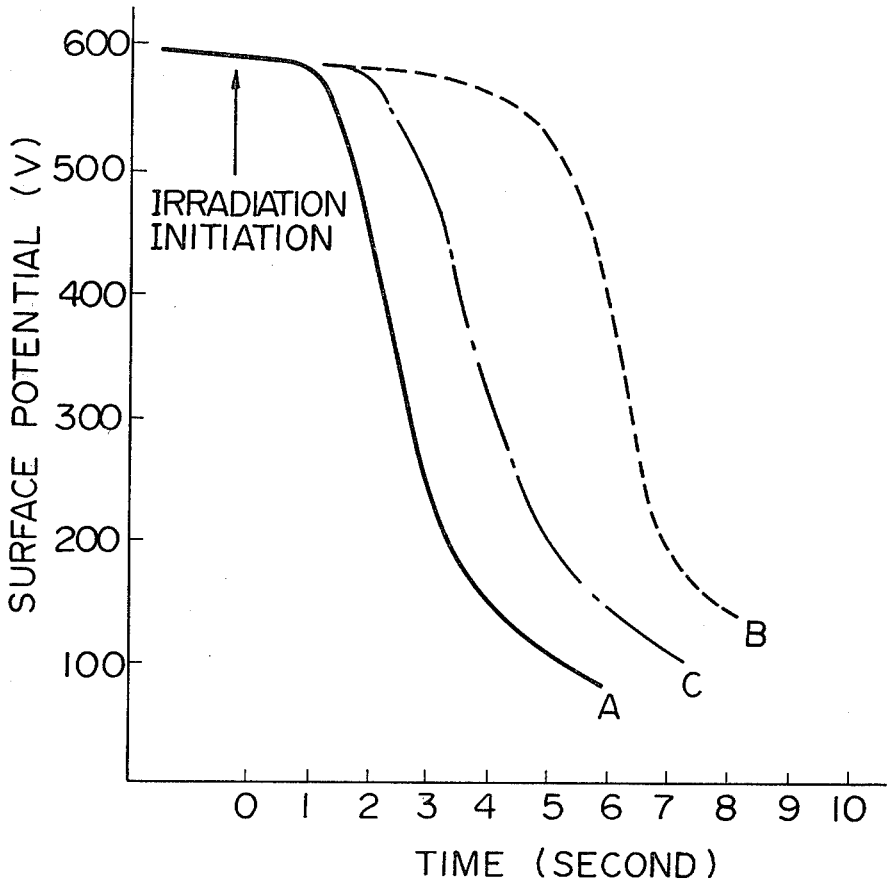
FIG. 3 is a graph showing photo-decay characteristics of the photosensitive material of the present invention (curve A) and the conventional photosensitive material (curves B and C).

Each of the so-obtained photosensitive materials was charged by a corona discharge device (discharge voltage +7.2 KV). The surface potential was 600 V. The surface potential was photo-decayed from 590 V. The irradiation wavelength was 775 μm and the irradiation intensity was 2 $\mu W/cm^2$. The half-value exposure quantity was measured and the photosensitivity was determined with respect to each photosensitive material. The obtained results are shown in Table 2. Also, a change in surface potential with time was determined by irradiating each photosensitive material with rays having the above-mentioned wavelength and intensity. The irradiation was initiated from 600 V. The obtained results are shown in FIG. 3. As is seen from FIG. 3, the photosensitive material of the present invention is dramatically more photosensitive than conventional photosensitive materials. That is, as is shown by curves B (dotted line) and C (one dotted chain line), conventional photosensitive materials exhibited a very small photo-decay, even when irradiated with the rays. The half-value exposure quantities of the conventional photosensitive materials (B) and (C) amounted to 12 $\mu J/cm^2$ and 7.4 $\mu J/cm^2$, respectively. In contrast, in the case of the photosensitive material of the present invention, as is shown by curve A (solid line), the induction phenomenon was improved and the half-value exposure quantity was 4.2 $\mu J/cm^2$. These features indicate a high photosensitivity of the photosensitive material of the present invention.

EXAMPLE 2

Five types of photosensitive materials were prepared by using different proportions of β-type copper phthalocyanine to PVCz (PVCz-A, the same as that described in example 1) while keeping the amount of the polyester constant. The composition shown in Table 3 was charged in a polyethylene wide-mouthed bottle having an inner volume of 2 liters and was milled for 80 hours by using 600 g of alumina balls. The resulting coating dispersion was coated on an aluminum plate at a dried thickness of 10.0 μm according to the doctor blade coating method. The coated aluminum plate was then dried.

Each of the so-obtained photosensitive materials was charged by a corona discharge device (discharge voltage +7.5 KV), and the surface potential was photo-decayed from 700 V. The irradiation wavelength was 760 nm and the irradiation intensity was 10 $\mu W/cm^2$. The half-value exposure quantity was measured and the photosensitivity was determined with respect to each photosensitive material. The relation between the weight ratio of β-type copper phthalocyanine to PVCz (PVCz-A) and the reciprocal number of the half-value exposure quantity ($cm^2/\mu J$ are the units of photosensitivity) is shown in FIG. 2. In FIG. 2, the signals A, B, C, D and E correspond to the samples A, B, C, D and E, respectively, shown in Table 3. It is apparent from FIG. 2 that when the weight ratio of copper phthalocyanine to PVCz was in the range of from 1.2 to 12, a good photosensitivity (0.2 $cm^2/\mu J$ or more) was obtained. It is also apparent that particularly when the weight ratio was in the range of from 2 to 7, the photosensitivity depicted an approximately flat curve and the highest photosensitivity was 0.5 $cm^2/\mu J$ (sample D in Table 3). On the other hand, a weight ratio of copper phthalocyanine to PVCz outside the scope of the present invention, e.g. 0.8, gave a remarkably low photosensitivity of 10.5 $\mu J/cm^2$ (sample A in Table 3). The sample of the present invention in which the weight ratio of copper phthalocyanine to PVCz was for example 3.2, exhibited a charge potential of 830 V (sample C in Table 3). In contrast, the sample outside the scope of the present invention in which the weight ratio of copper phthalocyanine to PVCz was for example 15, exhibited a low charge potential of 480 V.

TABLE 3

| | Sample | | | | |
|---|---|---|---|---|---|
| | A (comparison) | B | C | D | E |
| β-type copper phthalocyanine[1] (g) | 17.8 | 24.6 | 30.5 | 33.3 | 35.5 |
| PVCz[2] (g) | 22.2 | 15.4 | 9.5 | 6.7 | 4.5 |
| Polyester resin[3] (g) | 60 | 60 | 60 | 60 | 60 |
| Tetrahydrofuran (ml) | 1000 | 1000 | 1000 | 1000 | 1000 |
| Alumina ball (g) | 600 | 600 | 600 | 600 | 600 |
| β-type copper phthalocyanine/PVCz | 0.8 | 1.6 | 3.2 | 5.0 | 7.9 |
| Half-value exposure quantity ($\mu J/cm^2$) | 10.5 | 3.1 | 2.1 | 2.0 | 2.6 |
| Charge potential (V) | 852 | 850 | 830 | 800 | 750 |

Note
[1]"Lionol Blue SM" supplied by Toyo Ink Co.
[2]The same as that described in example 1
[3]"Polyester Adhesive #49000" supplied by Du Pont

EXAMPLE 3

The relation between the composition and the properties of photosensitive materials, in which the proportions of copper phthalocyanine (CuPc), PVCz (PVCz-A), and polyester resin (PES) were varied, was examined. The composition of the photosensitive materials is shown in Table 4. The copper phthalocyanine (CuPc) was "Lionol Blue ES" supplied by Toyo Ink Co. and had an ε-type crystal form. The PVCz (PVCz-A) and polyester resin (PES) used herein were the same as those used in Example 1.

TABLE 4

| Sample No. | ε-CuPc (g) | PVCz (g) | Polyester (g) | ε-CuPc/PVCz |
|---|---|---|---|---|
| A | 46 | 9 | 45 | 5:1 |
| B | 37 | 18 | 45 | 2:1 |
| C | 40 | 10 | 50 | 4:1 |
| D | 44 | 11 | 45 | 4:1 |
| E | 34 | 7 | 59 | 5:1 |
| F | 40 | 15 | 45 | 8:3 |
| G | 27.5 | 27.5 | 45 | 1:1 |
| H | 11 | 44 | 45 | 1:4 |
| I | 20 | 20 | 60 | 1:1 |
| J | 8 | 32 | 60 | 1:4 |
| K | 20 | 30 | 50 | 2:3 |
| L | 34 | 16 | 50 | 17:8 |
| M | 3 | 97 | 0 | 3:100 |
| N | 4.3 | 87.0 | 8.7 | 1:20 |
| O | 40 | 0 | 60 | — |
| P | 35 | 0 | 65 | — |
| Q | 50 | 0 | 50 | — |
| R | 60 | 0 | 40 | — |
| S | 30 | 0 | 70 | — |
| T | 70 | 0 | 30 | — |
| U | 80 | 0 | 20 | — |

The film-forming property, the charging property, and the photosensitivity were determined for each of the samples shown in Table 4. The evaluation of the film-forming property was carried out wholly by observing the presence of orange-peeling on the surface of the photosensitive film and the occurrence of agglomeration of the pigment in the film. Samples exhibiting orange-peeling, agglomeration, or both were considered poor in film-forming property.

The evaluation of the charging property was carried out by the following method.

Each sample (having a film thickness of 10 μm) was charged by a corona discharge device (discharge voltage +6.8 KV). The highest surface potential was determined while changing the grid voltage within the range of from +100 to 2000 V. The charging property is represented by the resultant highest surface potential. Samples exhibiting a highest surface potential of 500 V or less were considered poor in charging property.

The evaluation of the photosensitivity was carried out according to the same method as that described in Examples 1 and 2. Samples exhibiting a photosensitivity of 0.2 $cm^2/\mu J$ or less were considered poor in photosensitivity.

Figure 4:
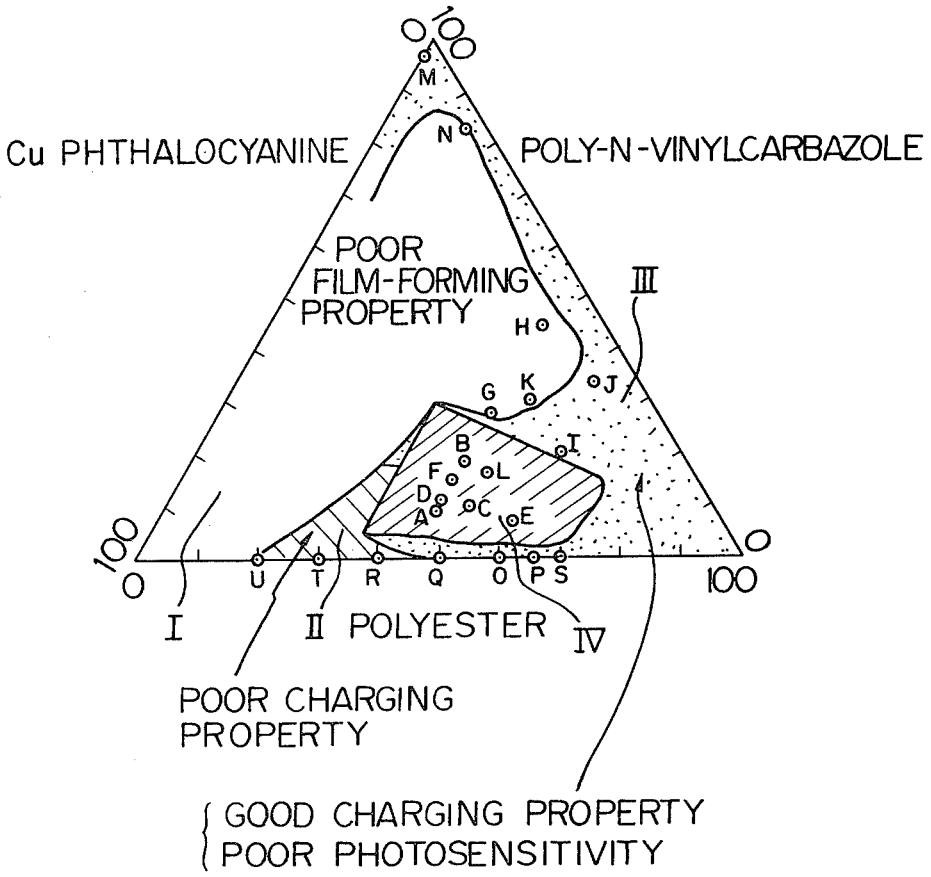
FIG. 4 is a triangle composition diagram showing the influences of the proportions of copper phthalocyanine (CuPc), PVCz, and a polyester resin (PES) in the photosensitive material on the properties.

The determined results are shown in FIG. 4.

Referring to FIG. 4, I denotes a region in which the film-forming property is poor, II denotes a region in which the charging property is poor, and III denotes a region in which the photosensitivity is poor and charging property is good. Also, IV denotes a region in which the film-forming property, the charging property, and the photosensitivity are all excellent. The photosensitive materials A, B, C, D, E, F, and L according to the present invention all fall within the region IV.

We claim:

1. A photosensitive material for electrophotography, which comprises a mixture of a phthalocyanine pigment, poly-N-vinyl-carbazole and an organic resin, wherein the weight ratio of said phthalocyanine pigment to said poly-N-vinyl-carbazole is in the range from 2 to 5, and the content of said phthalocyanine pigment is in the range from about 30 to 46% by weight, the content of said poly-N-vinyl-carbazole is in the range from 7 to 18% by weight and said organic resin is in the range from 45% to 60% by weight, based on the total amount of the photosensitive material.

2. A photosensitive material for electrophotography according to claim 1, wherein said phthalocyanine pigment is a copper phthalocyanine pigment.

3. A photosensitive material for electrophotography according to claim 1 or 2, wherein said poly-N-vinyl-carbazole has a weight average molecular weight of 300,000 or less.

4. A photosensitive material for electrophotography according to any of claims 1 or 2, wherein said organic resin is a polyester resin.

5. A photosensitive material for electrophotography according to claim 4, wherein said polyester resin has a weight average molecular weight of from 5000 to 400,000.

6. A photosensitive material for electrophotography according to claim 5, wherein said polyester resin has a weight average molecular weight of from 20,000 to 80,000.

7. The material of claim 3, wherein said organic resin is a polyester resin.

8. The material of claim 7, wherein said polyester resin has a weight average molecular weight of from 5000 to 400,000.

9. The material of claim 8, wherein said polyester resin has a weight average molecular weight of from 20,000 to 80,000.

10. The material of claim 1, 2, 5 or 6, consisting of said phthalocyanine pigment, poly-N-vinyl-carbazole and organic resin.

* * * * *

UNITED STATES PATENT AND TRADEMARK OFFICE

CERTIFICATE OF CORRECTION

PATENT NO. : 4,454,213

DATED : 12 June 1984

INVENTOR(S) : Yagishita et al

It is certified that error appears in the above-identified patent and that said Letters Patent is hereby corrected as shown below:

Column 2, line 33, "corporation" should be --Corporation--.

Column 3, line 33, "to" should be --of--.

Column 4, line 12, "resons" should be --reasons--;
line 33, "," should be --is--.

Column 5, line 23, "Mw, Mn and Mw/Mn" should be --$\overline{Mw}$, $\overline{Mn}$ and $\overline{Mw}/\overline{Mn}$--.

Signed and Sealed this

*Eleventh* Day of *December 1984*

[SEAL]

*Attest:*

GERALD J. MOSSINGHOFF

*Attesting Officer*

*Commissioner of Patents and Trademarks*